United States Patent [19]

Taylor

[11] 4,134,454

[45] Jan. 16, 1979

[54] MULTI-STAGE SLIDING VALVE FLUID OPERATED AND PRESSURE BALANCED

[75] Inventor: Donald F. Taylor, Dallas, Tex.

[73] Assignee: Otis Engineering Corporation, Dallas, Tex.

[21] Appl. No.: 835,058

[22] Filed: Sep. 21, 1977

[51] Int. Cl.[2] ..... E21B 43/12

[52] U.S. Cl. ..... 166/320; 137/629; 166/324

[58] Field of Search ..... 166/320, 321, 324, 332; 251/324, 62, 63, 63.5, 63.6, 63.4; 137/628, 629, 609, 612.1

[56] References Cited

U.S. PATENT DOCUMENTS

| | | | |
|---|---|---|---|
| 2,033,563 | 3/1936 | Wells | 166/320 |
| 2,842,162 | 7/1958 | Schwegman | 166/320 |
| 3,583,442 | 6/1971 | Dollison | 251/63.4 |
| 3,703,193 | 11/1972 | Raulins | 166/321 |
| 3,930,540 | 1/1976 | Holden et al. | 166/321 |
| 3,974,876 | 8/1976 | Taylor | 166/320 |

*Primary Examiner*—Ernest R. Purser
*Attorney, Agent, or Firm*—Vinson & Elkins

[57] ABSTRACT

Disclosed is an axially movable valve for admitting fluid to a fluid starved region. The admitted fluid feeds a pressure generating pump. Fluid pressure generated by the pump provides a force to further open the valve and to move a tool actuator. The valve opens with minimal sliding friction resistance. During the opening sequence, the flow area of the valve gradually increases. This abstract is neither intended to define the scope of the invention, which, of course, is measured by the claims, nor is it intended to limit the invention in any way.

16 Claims, 13 Drawing Figures

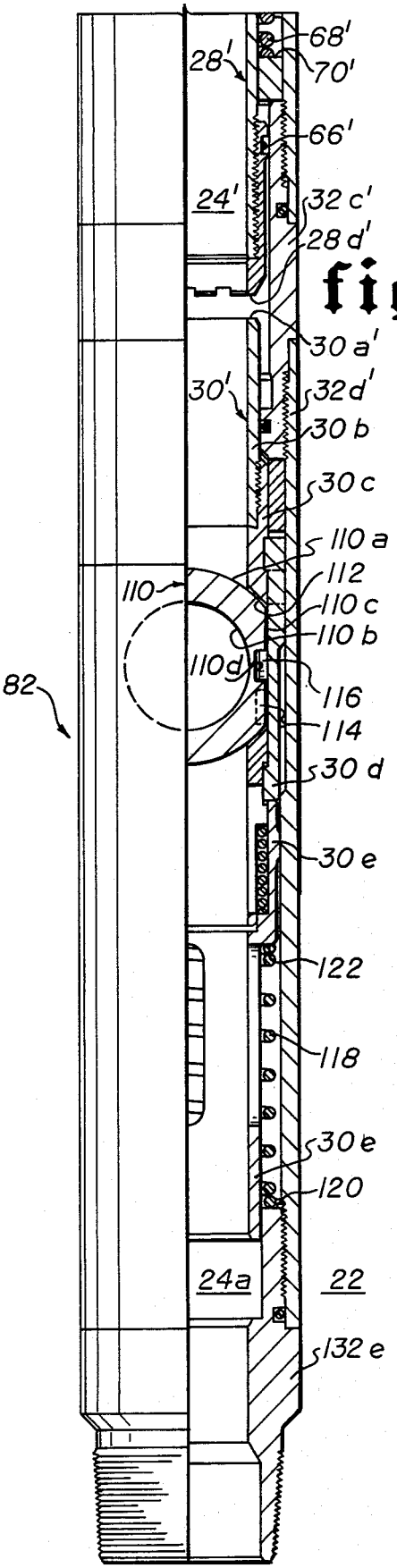
fig. 10B
fig. 11B
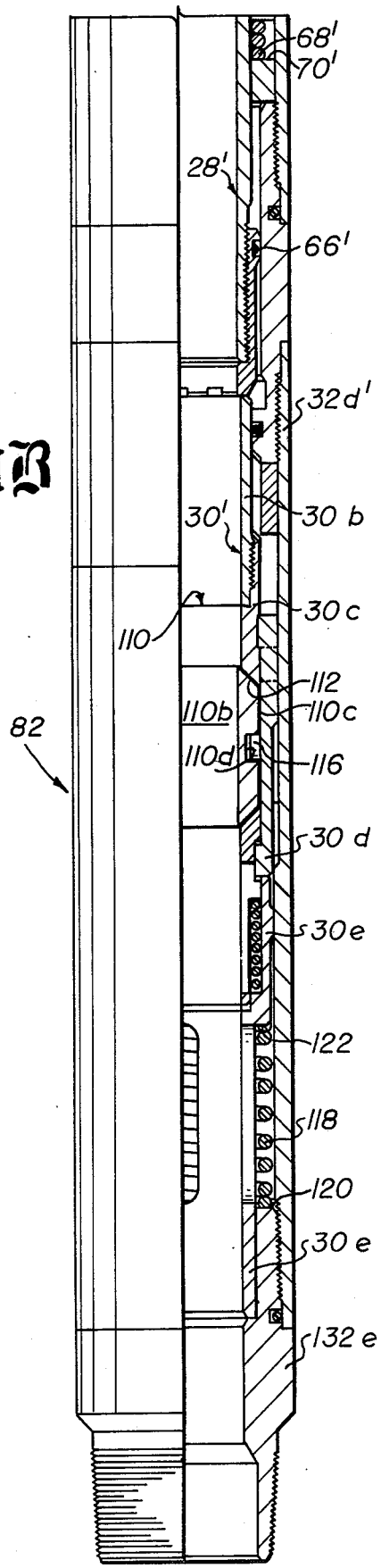

MULTI-STAGE SLIDING VALVE FLUID OPERATED AND PRESSURE BALANCED

BACKGROUND OF THE INVENTION

1. Field of the Invention

This invention relates to a sliding valve which slides to its open position with minimal frictional resistance. The valve may be opened repeatedly without fluid flow therethrough causing wire drawing, flow cutting, or errosion of sealing components.

2. The Prior Art

The valve member of a poppet valve may be spring loaded. The spring force may be adjusted so that the valve member is movable to a position opening the poppet valve upon the application of any desired force, including a low force.

Valves having a sliding sleeve valve member presently do not have the responsiveness of a poppet valve. For example, the sleeve valve member generally carries two spaced seals. One of these seals is moved across the controlled flow port. However, when the valve member is in a position closing the flow port, both seals are subjected to a differential pressure. The pressure differential causes each seal to assume a position sealingly engaging an opposing surface. The sealing engagement of the seal generates a frictional force between the seals and the opposing surface. The frictional force retards movement of the sliding valve member. That frictional force can be reduced to approximately 40% of the pressure differential for each seal. Therefore a sliding valve having two seals requires a force of approximately 80% of the pressure differential to move the sliding valve member. For some applications, that required force is too large.

Some subsurface safety valves include a secondary valve. The secondary valve may be opened prior to movement of the primary valve towards its open position. Fluid pressures are thereby equalized across the primary valve prior to its movement towards its open position. The sealing surfaces for an equalizing valve may comprise metal-to-metal seats (see pages 3998–4002 of the "COMPOSITE CATALOG OF OILFIELD EQUIPMENT AND SERVICES" 1974–75 edition and U.S. Pat. Nos. 3,703,193 and 3,583,442) and/or a resilient seal element (see page 475 of the "COMPOSITE CATALOG OF OILFIELD EQUIPMENT AND SERVICES" 1976–77 edition). The flow area of the equalizing flow passage is relatively small. Because of the small flow area, a volume of fluid sufficient to feed a pressure generating pump cannot flow through the equalizing flow passage. However, enlarging the equalizing flow passage would increase the tendency of fluid flow therethrough to cause wire drawing of the sealing components. The wire drawing effect will increase if the equalizing valve is opened while a pressure differential exists. Once wire drawing occurs, flow cutting and errosion follow. Thereafter, the valve can no longer positively close the equalizing flow passage.

OBJECTS OF THE INVENTION

An object of this invention is to provide an easily opened sliding valve for admitting fluid to a region initially starved for fluid so that the admitted fluid can be used by a fluid pressure generator.

Another object of this invention is to reduce the likelihood of wire drawing of valve sealing components for a sliding valve which has a large flow area, which is easily moved to its open position and which must be repeatedly opened and closed with a pressure differential thereacross.

Another object of this invention is to restrict fluid flow through a sliding valve so that during valve opening and closing, the flow area increases and decreases in discreet stages.

Another object of this invention is to provide a sliding valve wherein as the valve is opened, the effective flow area through the valve is controlled, as quickly as possible, by flow restriction means spaced from the valve's seal so that high velocity fluid flow across the valve's seal is minimized.

These and other objects and features of advantage of this invention will be apparent from the drawings, the detailed description, and the appended claims.

BRIEF DESCRIPTION OF THE DRAWINGS

In the drawings, wherein like numerals indicate like parts, and wherein an illustrative embodiment of this invention is shown:

FIGS. 10A and 10B are continuation views, in quarter-section, of a tool useable in the installation of FIG. 9 which tool also incorporates the valve of FIGS. 1 through 8; and FIGS. 11A and 11B are continuation views, in quarter-section showing the tool of FIGS. 10A and 10B in another operative position.

DETAILED DESCRIPTION OF THE PREFERRED EMBODIMENT

Certain installations rely upon a pump to pressurize fluid for actuation of a tool. However, initially, only a small amount of fluid is available to feed the pump. Therefore, the pressure to which the pump can pressurize that small amount of fluid is relatively low. Fluid must be made available to the pump so that the pump can in turn pressurize that fluid. When the fluid is sufficiently pressurized, a force is generated thereby which will move the tool actuator. The pump is thus starved for a sufficient amount of fluid which will actuate the tool until fluid from a convenient source is admitted thereto.

Figure 1:
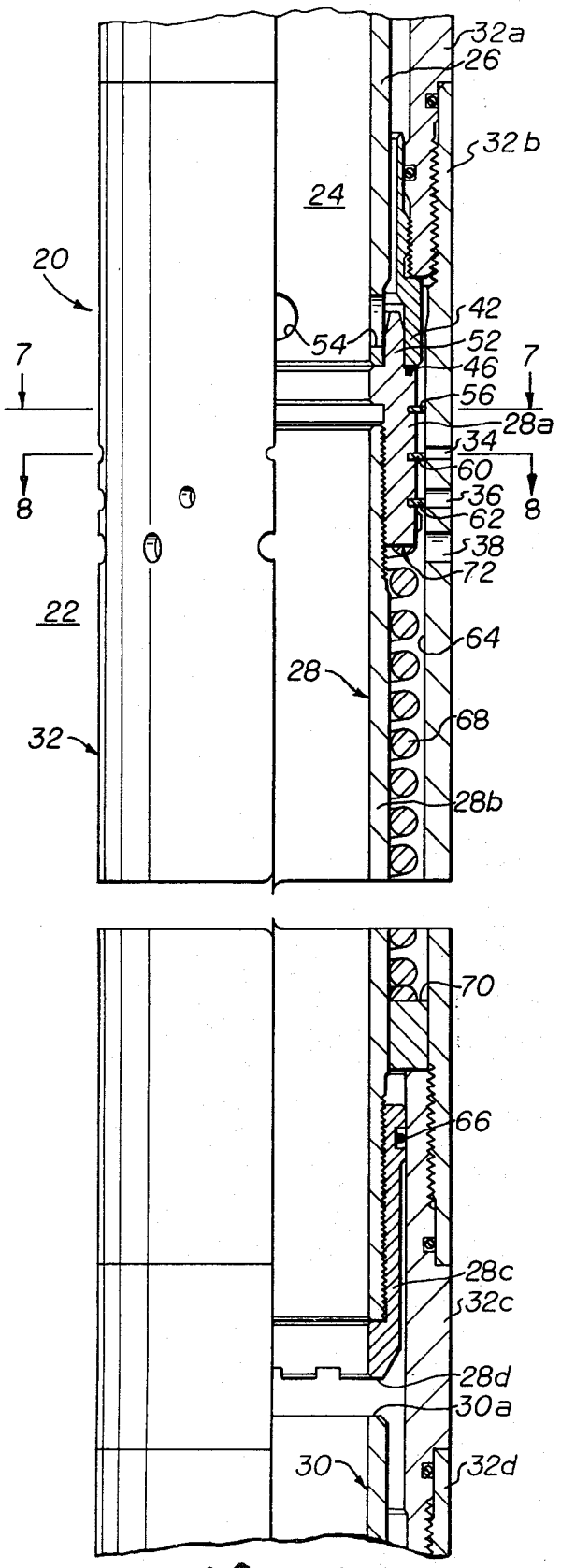
FIG. 1 is a quarter-sectional view of a sliding valve in accordance with this invention.
Figure 2:
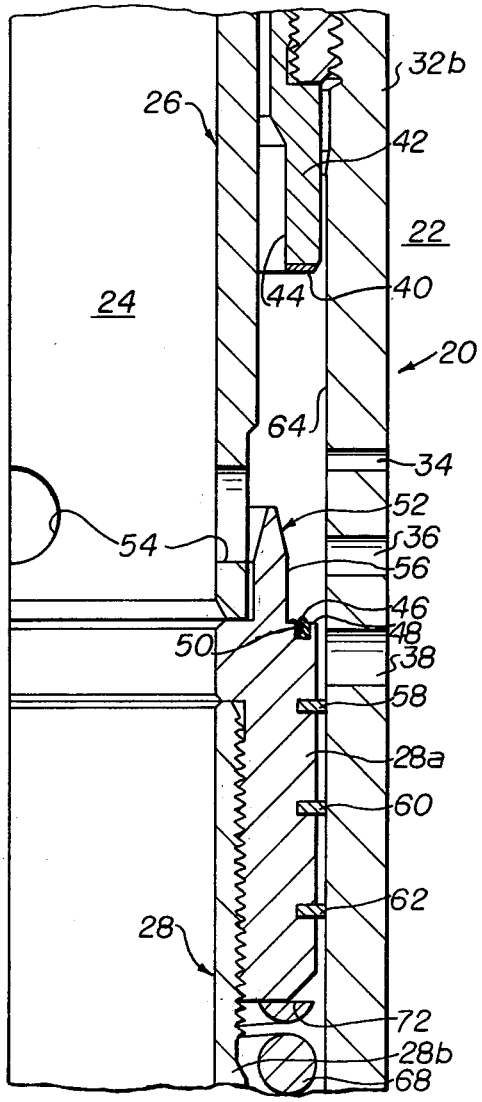
FIG. 2 is an enlarged partial view, in quarter-section, of the valve of FIG. 1 with the valve in the full open position.

FIG. 1 illustrates an installation having a sliding valve means 20 for admitting fluid to such a pressure generating pump. The valve 20 is easily movable between a first, closed position (see FIG. 1) and a second, fully open position (see FIG. 2). During the opening sequence, fluid is admitted from a first region 22, which is a source of fluid, to a second region 24, which is initially starved for fluid. Once within the fluid starved region 24, the fluid feeds a pressure generating pump (not shown). The pump (not shown) provides a source of pressurized fluid which affects operator means 26. Operator means 26 in turn moves valve mandrel means 28 to thereby move valve means 20 towards its second, fully open position. As an increased amount of fluid is admitted to the pressure generating pump, the pump increases the pressure of fluid affecting operator means 26. Once the pressure force affecting operator means 26 increases to a sufficient amount, tool actuator means 30 is engaged. Tool actuator means 30 thereafter moves in response to movement of operator means 26. Movement of tool actuator means 30 actuates a tool (not shown) in the installation.

The sliding valve means 20 includes housing means 32 for defining the two regions 22 and 24. As illustrated, housng means 32 may be tubular. The first region 22 is exterior of housing means 32. The second region 24 is defined by the bore of housing means 32. To form housing means 32, several tubular members 32*a*, 32*b*, 32*c* and 32*d* are interconnected.

Passage means communicates between the two regions 22 and 24. The effective flow area through the passage means gradually increases during the movement of sliding valve means 20 from its first operative position towards its second operative position. During the initial movement of valve means 20 from its first operative position, the effective flow area of the passage means is rather small. When valve means 20 is in its second operative position, the effective flow area of the passage means is rather large. The passage means is formed so that its effective flow area may be controlled during the movement of valve means 20 between its first and second operative positions and so that fluid flow through the passage means may be restricted to thereby protect sealing components of valve means 20. During the opening sequence of the sliding valve 20, fluid flow through the passage means is controlled and restricted so that the effective flow area through the passage means is defined by sealing components of the valve for as short a time as possible. Throughout the major portion of the opening sequence, the effective flow area through the passage means is defined by components of the valve 20 which are spaced from the sealing components. In such a manner, high velocity fluid flow through the passage means occurs across these other components rather than across sealing components. Additionally, the passage means is formed so that its effective flow area may progressively increase as rapidly as possible as the valve is opened and conversely, progressively decrease as rapidly as possible as the valve is closed. In the illustrated valve 20, port means extend laterally through housing means 32 and define a portion of the passage means. Several series of port means are spaced longitudinally along housing means 32. Spacing port means longitudinally along housing means 32 provides a rapid change for the effective flow area of the valve 20 as valve mandrel means 28 moves thereby and enables a second stage control of that rapidly changing effective flow area. However, it is to be understood that any means of providing a rapidly changing flow area for the passage means, which may be staged controlled, may be used in lieu of the illustrated longitudinally spaced series of port means. The illustrated sliding valve 20 has three series of longitudinally spaced port means 34, 36 and 38. With several series of port means, the flow area through the passage means may be controlled to progressively increase and decrease during valve opening and closing respectively. For example, in the illustrated valve means 20, the effective flow area for the passage means increases in stages as the valve means 20 moves from its first closed position (see FIG. 1) to its second fully open position (see FIG. 2). Conversely, the flow area decreases in stages as the valve means 20 moves from its second operative position to its first operative position. To further progressively change the flow area during movement of valve means 20, the flow area through each series of port means varies. For example, the first series of port means may include four holes 34 drilled laterally through the wall of housing section 32*b* and each having a one-eighth inch (⅛") diameter. The second series of port means may include six holdes 36 with each having a one-fourth inch (¼") diameter. The third series port means may include eight holes 38 having a three-eigths inch (⅜") diameter.

Seat means 40 is carried by housing means 32. Seat means 40 is formed on seat member means 42 and is disposed adjacent to the passage means extending between the two pressure regions 22 and 24. To reduce the forces required to move valve means away from seat means 40, seat means 40 is an annular seating surface. The plane of seat means 40 is substantially perpendicular to the longitudinal axis of movement of valve mandrel means 28.

During a portion of the opening and closing sequence of sliding valve means 20, flow through the passage means will be restricted due to the spaced relationship between seat member means 42 and valve mandrel means 28. Seat member means 42 includes a cylindrical surface 44 extending from the seat means 40. The cylindrical surface 44 is sized relative to valve mandrel means 28 to define a restricted flow area between it and the valve mandrel means 28.

The position and movement of valve mandrel means 28 controls flow between the two pressure regions 22 and 24 through the passage means. The valve mandrel means 28 is axially movable with respect to housing means 32 between a first position (see FIG. 1) and a second position (see FIG. 2). When valve mandrel means 28 is in its first position flow through the passage means is prevented. When valve mandrel means 28 is in its second position, the sliding valve means is fully opened and flow through the passage means is substantially non-restricted.

During movement of valve mandrel means 28, flow through the passage means is restricted.

Seal means 46 is carried by the valve mandrel means 28. Seal means 46 is formed from a resilient, elastomeric seal element. When valve mandrel means 28 is in its first position, seal means 46 sealingly engages seat means 40. Because it is resilient and elastomeric, seal means 46 may be repeatedly moved off of and onto seat means 40, even while a substantial pressure differential exists between the two pressure regions 22 and 24, without losing its sealing capabilities as long as it is protected from the effects of wire drawing, flow cutting, and erosion.

Forming valve mandrel means 28 are inter-connected tubular sections 28*a*, 28*b*, and 28*c*. Valve mandrel means 28 is formed to carry seal means 46 so that seal means 46 may sealingly engage the downwardly facing seating surface 40. Additionally, the valve mandrel means 28 is formed to substantially reduce the likelihood that fluid flow past the resilient seal means 46 will cause wire drawing, flow cutting, or erosion of seal means 46. To carry seal means 46 so that it may easily engage and disengage from seating surface 40, valve mandrel means 28 includes an annular, upwardly facing shoulder 48 which is substantially parallel to the plane of the downwardly facing seating surface 40. Within the annular shoulder 48 is formed annular recess means 50. The annular recess means 50 opens upwardly. Recess means 50 and seal means 46 are sized so that seal means 46 is received substantially within annular recess means 50. Only a portion of seal means 46 protrudes from annular recess means 50. A major portion or seal means 46 is therefore encapsulated within valve mandrel means 28. To assume that seal means 46 will not be washed out of recess means 50, seal means 46 preferably is bonded to valve mandrel means 28 by a suitable bonding agent.

A high rate of fluid flow substantially parallel to the annular shoulder 48 and across the protruding portion of seal means 46 could cause wire drawing, flow cutting and erosion of seal means 46. Fluid flow across the protruding portion of seal means 46 is prevented by nose means 52. Nose means 52 is formed on valve mandrel section **28*a* and extends substantially perpendicular to the plane of annular shoulder 48 and projects into the flow path of fluids flowing between the two pressure regions 22 and 24. To further assure that a high velocity flow rate does not occur across the resilient seal means 46, the passage means provides a tortuous, non-linear flow path. A portion of passage means is defined by port means 54 extending laterally through operator means 26 and opening into one pressure region 24. The nose means 52 extends partially across port means 54. Therefore, fluids flowing through port means 54 must also flow around nose means 52. Such a tortuous flow path further assures that a high velocity flow rate will not occur across and adjacent to resilient seal means 46**.

The rate of fluid flow through the passage means is controlled during movement of valve mandrel means 28 by multiple flow restriction means. The multiple flow restriction means are staged and further assist in preventing a high velocity fluid flow rate past resilient seal means 46. During the opening sequence of sliding valve means 20, initially, the effective flow area through the valve is defined, in part, by seal means 46. The multiple flow restriction means quickly becomes effective and thereafter defines the effective flow area through the passage means throughout the major portion of movement of valve mandrel means 28 towards its second position. Each of the multiple flow restriction means are spaced from seal means 46. Therefore, once the flow restriction becomes effective and defines the valve's effective flow area, the highest velocity of fluid flow through the passage means occurs between valve components which form the flow restriction means and the velocity of fluid flow across seal means 46 is substantially reduced. During the valve's closing sequence, the multiple flow restriction means causes a pressure differential to exist between the two regions 22 and 24. The pressure differential assists in moving the valve mandrel means 28 to its first position.

The first stage of restricted flow through the passage means occurs during an initial portion of the movement of the sliding valve means 20 from its closed, first portion toward its second, fully open position. As can be seen from FIG. 1, when the sliding valve 20 is closed, nose means 52 is disposed radially inwardly of the inwardly facing cylindrical surface 44 of seat member means 42. Nose means 52 includes a radially outwardly facing cylindrical surface 56. The diameter of surface 56 is slightly less than the diameter of the surface 44. Due to the close proximity of these two opposing surfaces, a very small annular flow area exists between the surface 44 associated with valve housing means 32 and the surface 56 associated with valve mandrel means 28. When seal means 46 moves away from seat means 40, initially flow through the passage means is confined to the small cylindrical effective area between seal means 46 and sealing surface 40. (The cylindrical effective flow area increases as valve mandrel means 28 moves towards its second position.) IF seal means 46 continued to define, in part, the effective flow area through the passage means for any appreciable time, high velocity fluid flow occur across seal means 46 and would cause wire drawing and erosion of seal means 46. Therefore, as quickly as possible, fluid flow through the passage means becomes restricted by a first flow restriction means. The first flow restriction means comprises the outwardly facing surface 56 of nose means 52 and the inwardly facing surface 44 of seat member means 42. The effective flow area through the passage means is restricted to the small annular area between surfaces 44 and 56. The first flow restriction means, practically instantaneously with the movement of seal means 46 away from sealing surface 40, restricts fluid flow through the passage means and defines the effective flow area through the passage means. Once the effective flow area through the passage means is defined by the first flow restriction means, the highest velocity of fluid flow through the passage means occurs between surfaces 44 and 56 rather than across seal means 46. Fluid flow remains restricted to the defined small annular effective flow area between surfaces 44 and 56 once valve mandrel means 28 moves axially a very short distance from its first, FIG. 1 position until valve mandrel means 28 moves a distance approximately equal to the length of surface 56. The surface 56 then is no longer opposite the surface 44. The first flow restriction means is rendered ineffective and the effect of a second stage of flow restriction means becomes dominant.

Figure 4:
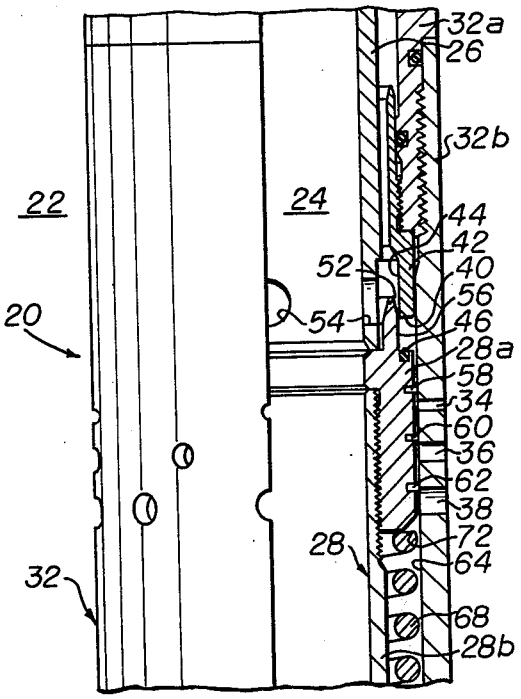
FIG. 4 is another partial quarter-sectional view of the valve of FIG. 1 showing a subsequent stage of the opening sequence.

FIG. 4 illustrates the configuration of the sliding valve 20 with valve mandrel means 28 in a position wherein the first flow restriction means is no longer effective. A second stage of flow restriction means will thereafter restrict flow through the passage means during substantially all of the remaining portion of the movement of the valve mandrel means 28 towards its FIG. 2 position. The second stage flow restriction means cooperate with the sized and longitudinally spaced port means 34, 36, and 38. An ever increasing flow area through the passage means is provided by the action of the second stage of flow restriction means. Consequently an ever increasing volume of fluid is admitted from the fluid source region 22 to the fluid starved region 24. The components forming the second stage of flow restriction means are also spaced from seal means 46. Therefore, while this second stage of flow restriction means is effective, the highest velocity of fluid flow through the passage means will be confined to valve components forming the second stage of flow restriction means and will not occur across seal means 46. Additionally, the second stage of flow restriction means presents little frictional resistance to axial movement of valve mandrel means 28. The second stage of flow restriction means may comprise at least one, but preferably a plurality of ring means such as rings 58, 60 and 62 illustrated. The ring means 58, 60 and 62 are carried on valve mandrel section 28a in spaced relationship. They are sized to slidably engage the opposing radially inwardly facing surface 64 of valve housing section 32*b*. During movement of valve mandrel means 28, flow through the passage means is restricted by the ring means 58, 60 and 62. The ring means 58, 60 and 62, however, do not sealingly engage the inwardly facing surface 64. Therefore, when valve mandrel means 28 is stationary, the fluid pressure on opposite sides of each ring means 58, 60 and 62 is quickly equalized. The ring means 58, 60 and 62 are carried on valve mandrel section 28a in a spaced relationship such that during movement of valve mandrel means 28 between its first and second positions, fluid flow through each series of port means 34, 36 and 38 is selectively restricted.

For example, during movement of valve mandrel means 28 from its FIG. 1 position to its FIG. 4 position, fluid flow through all of the port means 34, 36 and 38 is restricted by the effect of ring means 58. Additionally, ring means 60 further restricts flow through port means 36 and 38 while ring means 62 still further restricts flow through port means 38.

Figure 5:
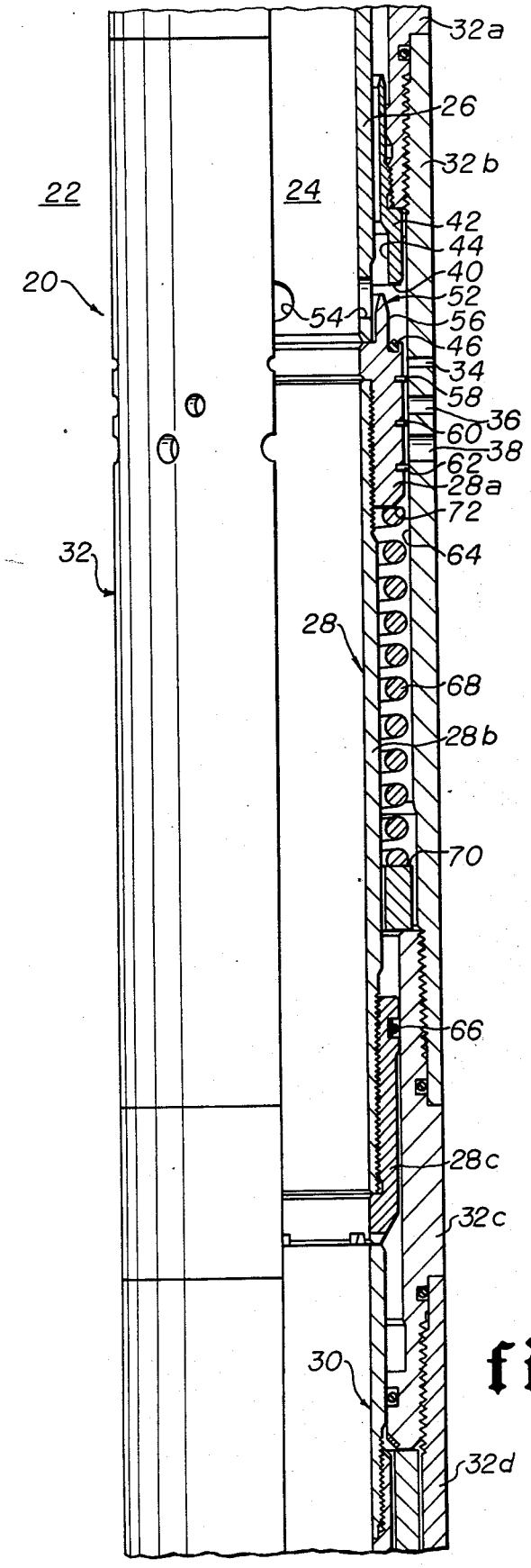
FIG. 5 is another partial quarter-sectional view of the valve of FIG. 1 showing another subsequent stage of the opening sequence.

While valve mandrel means 28 is moving from its FIG. 4 position to its FIG. 5 position, the effective flow area through the passage means is restricted and defined by the flow area around ring means 58.

Valve mandrel means 28 continues its movement towards its second position. Ring means 58 passes port means 34 (see FIG. 5). The flow area through the passage means is now substantially equal to the sum of the flow area of port means 34 and the flow area around ring means 58. It will be noted that ring means 62 no longer restricts flow through any of the port means. However, ring means 60 continues to restrict flow through port means 38.

Figure 6:
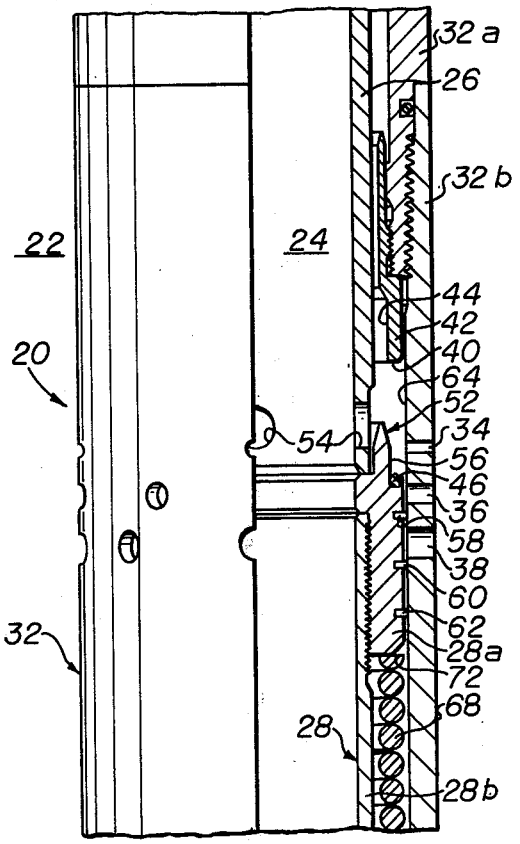
FIG. 6 is still another partial quarter-sectional view of the valve of FIG. 1 showing still another subsequent stage of the opening sequence.

Upon continued downward movement of valve mandrel means 28, ring means 58 passes the next series of port means 36 (see FIG. 6). Ring means 60 and 62 are now no longer effective to restrict flow. Therefore, the flow area through the passage means is substantially equal to the sum of the flow area through port means 34, the flow area through port means 36 and the flow area around ring means 58.

Finally, the valve mandrel means 28 reaches its second position. The maximum flow area through the passage means is attained. The ring means 58, 60 and 62 no longer restrict flow through any of the port means 34, 36 and 38. Valve mandrel means 28 ceases its axial movement. Fluid pressures on opposite sides of each ring means 58, 60 and 62 quickly equalize.

Figure 7:
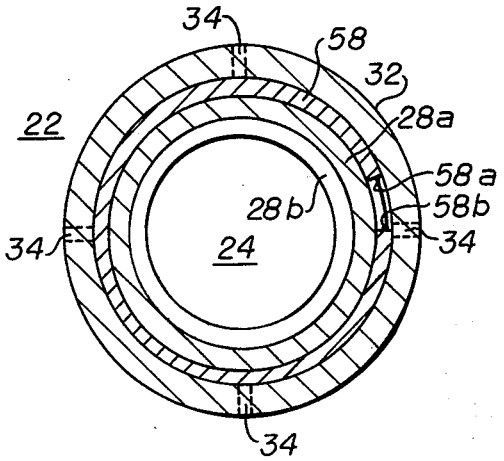
FIG. 7 is a cross-sectional view taken along line 7—7 of FIG. 1.
Figure 8:
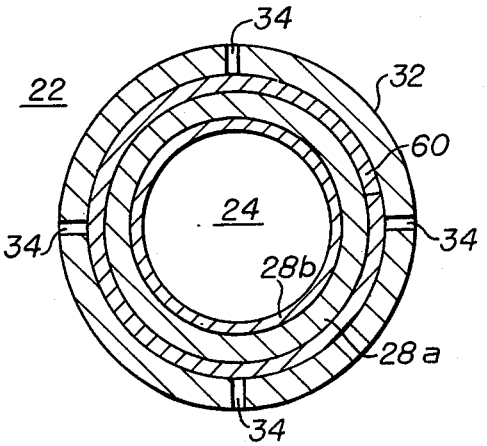
FIG. 8 is a cross-sectional view taken along line 8—8 of FIG. 1.

If desired, a sized gap may be provided between the ends of a selected ring means. Fluid flow past that ring means would then be substantially restricted to the flow area defined by that sized gap. For example, as seen in FIG. 7, the ends 58*a* and 58*b* of ring means 58 do not abut. Instead, a sized gap is provided therebetween. During movement of the valve mandrel means 28, ring means 58 therefore substantially restricts fluid flow to the area defined between its ends 58*a* and 58*b*. However, as seen in FIG. 8, the ends of ring means 60 abut. Therefore, during movement of valve mandrel means 28, fluid flow is substantially restricted across ring means 60. Ring means 62 may be formed similar to ring means 60. Its ends would also abut and fluid flow across it would also be substantially restricted during movement of valve mandrel means 28.

When the valve means is in its first position and closes the passage means, the fluid pressure of the two regions 22 and 24 will be different. The differential fluid pressure between the two regions 22 and 24 will result in a pressure force being applied to valve mandrel means 28. A first axial pressure force will be proportional to the pressure differential between the two regions 22 and 24 and the seal effective area of seal means 46. That force will tend to maintain valve mandrel means 28 in its first, closed position. Instead of operator means 26 having to apply a force to valve mandrel means 28 sufficient to overcome the first axial pressure force, valve mandrel means 28 is axially pressure balanced. Seal means 66 seals between valve mandrel means 28 and valve housing means 32. Seal means 66 is sized so that its seal effective area is substantially equal to the seal effective area of seal means 46. Therefore, when the valve means 20 is closed, the pressure differential between the pressure regions 22 and 24 creates a second axial pressure which also affects valve mandrel means 28. That second pressure force will be proportional to the differential pressure and the seal effective area of seal means 66. The first and second axial pressure forces act upon valve mandrel means 28 in opposite directions. The differential pressure across seal means 46 will be equal to the differential pressure across seal means 66. Therefore, the less difference between the seal effective areas of seal means 66 and seal means 46, the smaller will be the net axial pressure force which is effective upon valve mandrel means 28.

Means 68 yieldably urge valve mandrel means 28 to its first position. The yieldable urging means 68 may be a coil compression spring disposed between an upwardly facing shoulder 70 associated with valve housing means 32 and a downwardly facing shoulder 72 formed on valve mandrel means 28.

Operator means 26 moves the valve means from its first position to its second position. Pressure responsive means (not shown in FIGS. 1 through 8) are carried by operator means 26. Pressurized fluid is effective across the pressure responsive means. When the fluid is pressurized a sufficient amount, operator means 26 moves axially with respect to valve housing means 32. The axial movement of operator means 26 in turn imparts axial movement to valve mandrel means 28.

In operation, the sliding valve 20 controls the admission of fluid from a fluid pressure source region 22 to a fluid starved region 24. Initially, when the valve means 20 is in its first, closed, position, fluid cannot be admitted from the fluid source region 22 to the fluid starved region 24. At that time, seal means 46 sealingly engages seat means 40. However, valve mandrel means 28 is pressure balanced due to seal means 66. Therefore, substantially no fluid forces retard movement of valve mandrel means 28 from its first, FIG. 1, position towards its second, FIG. 6 position. Seal means 66 due to its sealing engagement with valve housing means 32, does create a frictional force which force tends to retard movement of valve mandrel means 28. The frictional force created by seal means 66 varies in proportion to the differential pressure acting thereacross. Spring means 68 also creates a yieldable force which tends to resist movement of valve mandrel means 28 to its second position. Therefore, to initiate movement of valve mandrel means 28 from its first position to its second position, a force is applied to operator means 26 which is greater than the sum of the frictional force created by seal means 66 and the yieldable force created by spring means 68.

During the opening sequence of sliding valve 20, fluid flows from the fluid source region 22 to the fluid starved region 24 at an ever increasing flow rate. Once within the fluid starved region 24, the fluid feeds a pressure generating pump. Fluid pressure generated by the pump affects the pressure responsive means carried by operator means 26. Operator means 26 is moved axially thereby. Operator means 26 in turn moves the valve mandrel means 28. Sometime during the opening sequence, enough pressure force is developed so that movement can be imparted to actuator means 30. At that time, valve mandrel means 28 is designed to engage actuator means 30 and initiate its movement. Sufficient movement of actuator means 30 actuates a tool of the installation.

The sequential operation to open the sliding valve 20 is illustrated in FIGS. 1 through 6.

FIG. 1 illustrates the configuration of the sliding valve 20 when it is closed, first position. Valve mandrel means 28 is in its first position and seal means 46 sealingly engages seat means 40. Notice that the lower downwardly facing end **28*d* of valve mandrel means 28 is spaced from the upper upwardly facing end 30*a* of actuator means 30. To open the sliding valve 20, the pressure generating pump is turned on. Although the region 24 is initially starved for fluid, some residual fluid is present within that region 24. The residual fluid feeds the pressure generating pump. The pump pressurizes the fluid and discharges it. The pressurized discharge fluid affects the pressure responsive means carried by operator means 26. Operator means 26 is moved axially with respect to housing means 32 in a downward direction. Operator means 26 in turn moves valve mandrel means 28**.

Figure 3:
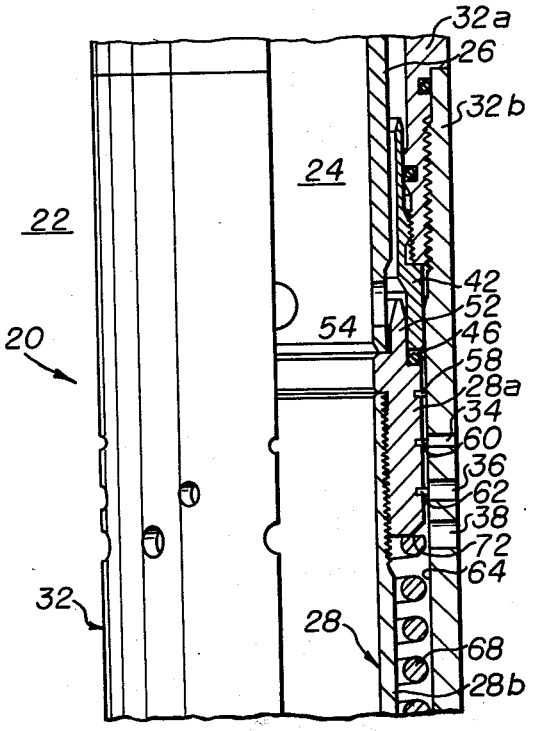
FIG. 3 is a partial quarter-sectional view of the valve of FIG. 1 illustrating an initial stage of the opening sequence.

Once valve mandrel means 28 moves axially downward a slight distance seal means 46 becomes spaced from seat means 40. Fluid flow through the passage means between the two pressure regions 22 and 24 is permitted. The effective flow area is initially defined by the increasing cylindrical area between seal means 46 and seating surface 40. However, as quickly as possible, a first flow restriction means becomes effective. As seen in FIG. 3, nose means 52 is initially disposed radially within and adjacent to seat member means 42. When the first flow restriction means becomes effective, the effective flow area of the passage means is defined by the opposed outwardly facing cylindrical surface 56 of nose means 52 and the inwardly facing cylindrical surface 44 of seat member means 42. That effective flow area is relatively small although larger than the initial, short lived, cylindrical effective flow area. Therefore, while the first flow restriction means is effective, only a small volume of fluid flows through the passage means. The first flow restriction means, by quickly defining an effective flow area through the passage means at a location spaced from seal means 46, reduces the velocity of fluids flowing across seal means 46. The likelihood of wire drawing and its adverse effects are consequently also reduced. The spaced cylindrical surfaces 56 and 44 therefore define the first stage of the flow restriction means for the sliding valve 20. That first stage of flow restriction means is effective until surface 56 is no longer opposite surface 44 (see FIG. 4).

Once valve mandrel means 28 reaches approximately the position illustrated in FIG. 4, the first stage flow restriction means is no longer effective. The effective flow area through the passage means is again increased. However, the second stage flow restriction means continues to restrict flow through the passage means. At this time, ring means 60 and 62 substantially restrict all fluid flow through port means 36 and 38. However, some fluid flow through port means 34 is permitted. Ring means 58 controllably restricts that flow. As the valve mandrel means moves from approximately the position illustrated in FIG. 4 downwardly until ring means 58 passes port means 34, the fluid flow area through the passage means is substantially defined by the gap between the ends **58*a* and 58*b* of ring means 58**.

Fluid continues to be admitted through the passage means from the fluid source region 24 to the fluid starved region 22. The pressure generating pump has an increased volume of feed fluid. The pump therefore increases the pressure of the discharged fluid. The pressurized fluid moves operator means 26 axially downwardly with respect to housing means 32. Movement of valve mandrel means 28 continues. Ring means 58 passes port means 34. Flow through port means 34 is thereafter no longer restricted. As seen in FIG. 6, ring means 60 continues to restrict flow through port means 38. Additionally, ring means 58 restricts fluid flow through port means 36. The effective flow area through the passage means expands substantially the sum of the area of port means 34 and the area of the sized gap of ring means 58.

By the time the sliding valve 20 has reached the configuration shown in FIG. 5, the pressure generating pump has been fed a sufficient volume of fluid so that a pressure force sufficient to initiate movement of the actuator means 30 is being generated. Therefore, at this time, the lower end **28*d* of the valve mandrel means 28 strikes the upper end 30*a* of the operator means 30. Thereafter, operator means 26 continues to move axially a distance sufficient to cause actuator means 30 to actuate a tool (not shown in FIGS. 1 through 8**).

Continued movement of operator means 26 and valve mandrel means 28 causes ring means 60 to pass port means 38. Now only ring means 58 is effective to restrict flow through port means 38. Additionally, flow through port means 34 and 36 are substantially unrestricted. The valve means is now in the configuration illustrated in FIG. 6.

Again, an increased volume of fluid feeds the pressure generating pump. The pressure of the pump discharge fluid increases. Operator means 26, valve mandrel means 28 and actuator means 30 all continue to move axially. Ring means 58 moves past port means 38. The sliding valve 20 attains its second, fully open position (see FIG. 2). Flow through the passage means is now substantially non-restricted. However, the flow path is tortuous and does not occur directly across resilient seal means 46. Seal means 46 remains protected. At this time, a relatively large effective fluid flow area is provided through the passage means.

A pressure generating pump has received a sufficient volume of fluid to enable it to generate a pressure which moves actuator means 30 a distance sufficient to actuate a tool. Fluid has been controllably admitted from the fluid source region 22 to the initially fluid starved region 24. That admission of fluid was restricted during the opening sequence of the sliding valve 20. The restriction was staged so that an ever increasing volume of fluid was feed to the pump. All the while, the flow path through the passage means was tortured so that the effects of wire drawing on seal means 46 have been substantially reduced.

The sliding valve 20 will remain in its second, open configuration (see FIG. 2) as long as operator means 26 is affected by fluid pressurized a sufficient amount. The fluid pressure must generate a force at least sufficient to overcome the upward acting force of the yieldable urging spring means 68.

If the downwardly acting pressure force which affects operator means 26 is reduced below that sufficient amount, for whatever reason, spring means 68 will initiate movement of the valve means from its second position to its first position. Once spring means 68 initiates upward movement of the valve mandrel means 28, the second stage flow restriction means again become effective. The ring means 58, 60 and 62 again act to restrict flow across themselves. As the ring means 58, 60 and 62 cross port means 34, 36 and 38, a choking effect is created for fluids flowing through the passage means. This choking effect results in a pressure differential across each ring means 58, 60 and 62. The high pressure region would be below each ring means 58, 60 and 62 while the low pressure region is above each ring means 58, 60 and 62. The resulting pressure differentials combine and create a force on valve mandrel means 28 which further assists spring means 68 in moving the valve means to its first position. However, as the valve mandrel means 28 moves towards its first position, the choking effect of the flow restriction means prevents the formation of a high velocity flow rate of fluid past seal means 46. Therefore, the resilient seal means 46 is not adversely affected by fluid flow.

Since the resilient seal means 46 is not adversely affected during either the opening or closing sequence of the sliding valve 20, the sliding valve 20 may undergo multiple opening and closing operations without failure. Even though a substantial pressure differential exists between the fluid source region 22 and the fluid starved region 24, the sliding valve 20 may be opened without adversely affecting seal means 46. Therefore, the pressure generating pump may be turned off and on, as desired, for whatever reason. Additionally, actuator means 30 may be moved to actuate a tool several times sequentially.

Figure 9:
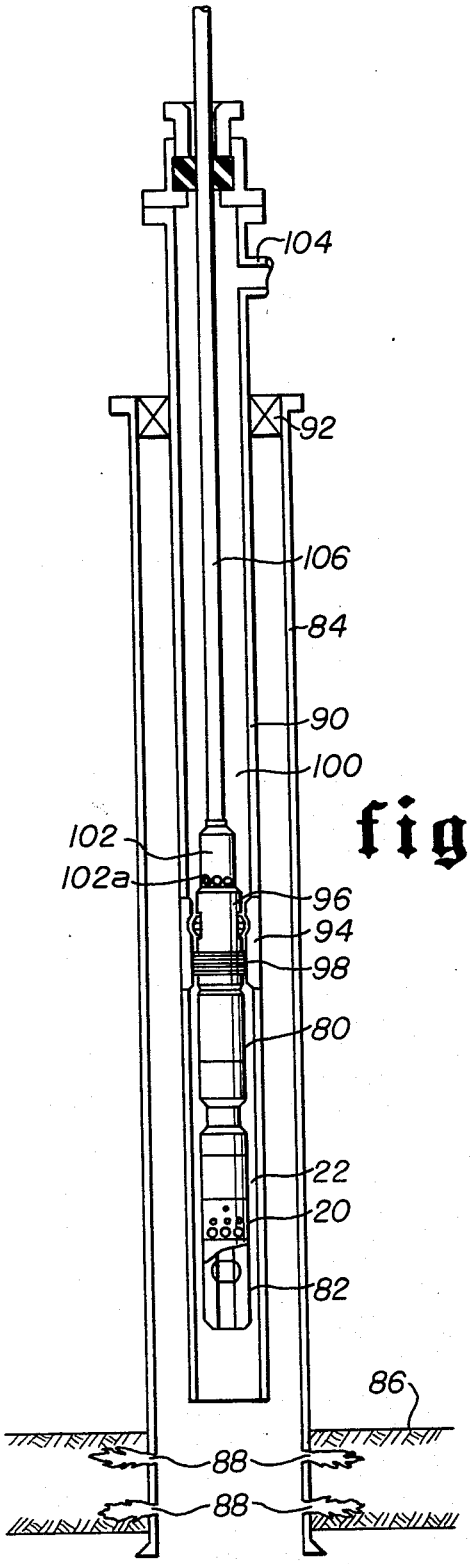
FIG. 9 is a schematic illustration of an installation incorporating the valve of FIGS. 1 through 8.

FIG. 9 illustrates schematically an installation incorporating a sliding valve 20. The installation is a well for the production of fluids. The sliding valve 20 admits fluid to feed a REDA (Trademark) pump 80. Pressurized discharge fluid from the REDA pump 80 in turn moves and maintains the sliding valve 20 in its open position and actuates well tool 82. Tool 82 may be the safety valve 82 shown. Upon actuation, the safety valve 82 opens the production fluid flow path. Thereafter, fluids may be produced from the well.

A REDA pump 80 may be positioned in a well installation to increase the flow rate at which fluids are produced from the well. The safety valve 82 would be positioned in the installation below the REDA pump 80 to positively shut-in the formation well fluids when desired.

Prior to positioning the REDA pump 80, sliding valve 20 and safety valve 82 in the well installation, the well will be drilled and cased with the normal casing string 84. Casing string 84 will extend between the surface installation and the subsurface formation 86. lateral perforations 88 through the casing string 84 and into the formation 86 permit well fluids to enter the casing string 84. A tubing string 90 is run through the casing string 84. Packer means 92 packs off between the casing string 84 and the tubing string 90 to confine the flow of well fluids to the bore through the tubing string 90. Within the tubing string 90 is formed a seating shoe 94 in which the REDA pump 80 and depending safety valve 82 is hung. The seating shoe 94 causes the weight of the REDA pump 80 and valve 82 to be suspended from the casing string 90 and also permits the isolation of the intake for the REDA pump 80 from the discharge of the REDA pump 80. A lock mandrel 96 is landed and locked in the seating shoe 94. The pressure generating pump 80 and safety valve 82 are suspended therebelow. Carried on the lock mandrel 96 are seal means 98 for sealing between the lock mandrel 96 and the seating shoe 94. Fluids from the formation 86 are thereby confined. The formation fluids must pass through the safety valve 82 and the pump 80 before being discharged into the tubing string bore 100 above the seating shoe 94. A discharge head and motor 102 is positioned above the lock mandrel 96. The discharge head 102 includes discharge ports **102*a* through which fluid is discharged into the bore 100 of the tubing string 90. Under the action of the REDA pump 80, the formation fluids are forced upwardly through the bore 100. A flow line 104 communicates with the tubing string 90. The well fluids are forced into the flow line 104 where they are communicated to other facilities (not shown). The subsurface installation, including the discharge head 102, lock mandrel 96, REDA pump 80 and safety valve 82 are all suspended in the tubing string 90 by a suspension cable 106. The suspension cable 106 includes electric conduit means for conducting electrically to a motor formed within the discharge head 102. When the motor is turned on, the pump 80 is actuated. The pump 80 in turn initiates the opening of the sliding valve 20 and actuates the safety valve 82**.

Figure 10A:
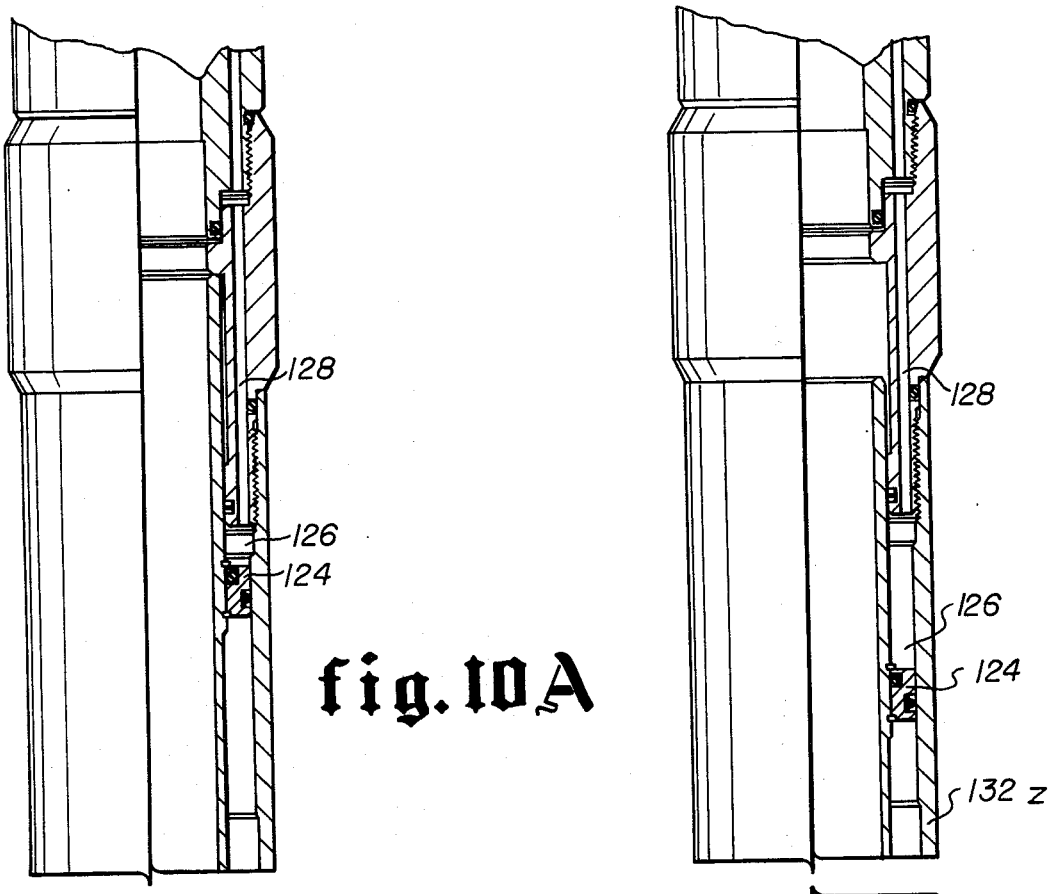
Figure 11A:
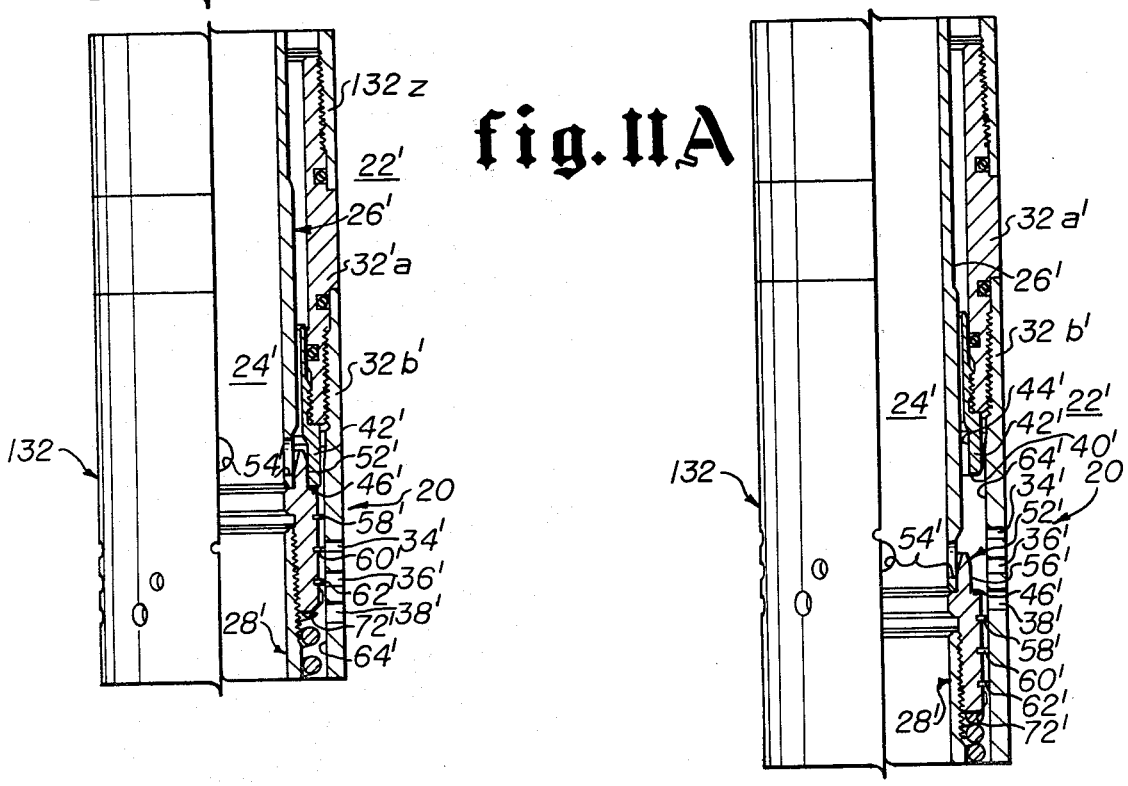

Further detail of the safety valve 82 and its interaction with the sliding valve 20 is illustrated in FIGS. 10A and 10B and 11A and 11B. In FIGS. 10A and 10B, both the sliding valve 20 and the safety valve 82 are closed. In FIGS. 11A and 11B, both are opened.

The sliding valve 20 is the same as previously described. Corresponding elements have been designated with corresponding numerals with the addition of a '.

As illustrated in FIGS. 10A and 10B, the sliding valve 20 and the safety valve 82 may be formed with a common housing means 132. Tubular housing sections **32*a*', 32*b*' and 32*c*' are associated with the sliding valve 20. Tubular housing sections 32*d*' and 132*e* depend therefrom and are associated with the safety valve 82**.

The safety valve 82 includes main valve means 110 for controlling flow through the longitudinally extending bore of housing means 132. When the main valve means 110 is in its first, closed position (see FIG. 10B) that portion 24' of the bore which is above the main valve means 110 becomes a fluid starved region 24'. That portion **24*a* of the longitudinally extending bore which is below the main valve means 110 is in communication with the fluid source region 22 surrounding housing means 32'. The illustrated main valve means 110 is a ball valve element. It includes an outer spherical seating surface 110*a* for seating with a complementary seat means 112 when the safety valve 82 is in its first position. It also includes passage means 110*b* extending therethrough which become aligned with the longitudinally extending bore 24 of housing means 132' when the safety valve 82** is in its second position.

The ball valve element 110 is moved axially with respect to valve housing means 32' to move it between its first, closed position and its second, full open position. During axial movement of the ball valve element 110, it is also rotated. The ball valve element 110 includes outer flat surfaces 110c in which are formed pivot slot means (not shown) and pivot bore means 110d. Stationary pivot pin means 114 (indicated in dotted line) project into the pivot slot means. Upon axial movement of the ball valve element 110, pivot pin means 114 imparts a moment to the ball valve element 110 to cause rotation thereof. Control pin means 116 projects into pivot bore means 114d. Control pin means 116 moves axially with respect to valve housing means 132 and maintain the rotational axis of the ball valve element 110 longitudinally aligned with housing means 132.

Actuator means 30' moves axially with respect to valve housing means 132 to actuate the safety valve 82. When actuator means 30' is in its first position (see FIG. 10B), the ball valve element 110 is in its first position and the safety valve 82 is closed. When actuator means is in its second position (see FIG. 11B), the ball valve element is also in its second position and the safety valve 82 is opened. Actuator means 30' comprises interconnected, axially movable sections 30b, 30c, 30d and 30e. Actuator section 30c includes the seat means 112 which is engaged by the ball valve element 110. Actuator section 30d comprises control arms upon which are formed control pin means 116. The longitudinal alignment of the control arms 30d is maintained during the axial movement of actuator means 30 so that the ball valve element 110 may freely rotate about its rotational axis.

Since the tool 82 is a safety valve, means 118 are provided for resiliently urging the main valve means 110 towards its first position. The resilient urging means 118 may be the coil compression spring means shown. Spring means 118 is confined between an upwardly facing shoulder 120 formed on valve housing means 32 and a downwardly facing shoulder 122 associated with actuator means 30. Spring means 118 urges the main valve means 110 to its first position by urging actuator means 30' to its first position.

Operator means 26' is pressure responsive and moves axially with respect to valve housing means 132 to move valve mandrel means 28' to its second position and thereby move actuator means 30' to its second position. As illustrated in FIG. 10A and 11A, pressure responsive means 124 are carried by operator means 26'. Control pressure chamber means 126 is formed between operator means 26' and an upper tubular section 132z of valve housing means 132. When control pressure chamber means 126 is pressurized a sufficient amount, a pressure force is exerted upon the pressure responsive means 124 which urges operator means 26' downwardly. Pressurized fluid may be admitted into control pressure chamber means 126 through communicating means 128 which extend upwardly to the source of pressurized fluid provided by the pressure generating pump.

In operation, the installation permits the controlled production of well fluids from the formation 86. The REDA pump 80 permits the production of a greater volume of fluid than would be possible without such a subsurface pump.

When the pump 80 is turned off, both the sliding valve 20 and the safety valve 82 are closed. The spring 68' moves valve mandrel means 28' and operator means 26' upwardly to the position shown in FIGS. 10A and 10B. Spring means 118 moves actuator means 30 upwardly to the position shown in FIG. 10B. The resilient seal means 46' engages seat means 40'. The lateral extending passage means through the housing means 132 is thereby closed. Main valve means 110 closes the longitudinally extending bore through housing means 132.

With the valves closed, two pressure regions develop. Shut-in formation pressure will be effective in the region 22 exterior of the housing means and in the bore portion 24a below main valve means 110. That shut-in formation pressure will resist any movement of actuator means 30' and main valve means 110 from their first, closed position. The force generated by the shut-in formation processes and resisting movement of the ball valve element 110 is greater than the initial pressure force which can be developed by the REDA pump 80.

A fluid starved region will exist within the bore 24' of housing means 32' extending above the closed main valve means 110. There will be some residual fluids within that fluid starved region 24'.

To actuate the safety valve 82 so that it opens and permits the production of well fluids, the electric motor for the pressure generating pump 80 is turned on. Electricity is conducted to the motor 102 through suspension cable 106. The motor 102 activates the pressure generating pump 80. Residual fluid within the fluid starved region 24' passes through an intake of the pressure generating pump 80. The fluid is pressurized by the pump 80 and discharged. The pressurized discharge fluid is conducted through communicating means 128 to control pressure chamber means 126. When chamber means 126 is pressurized a sufficient amount, a force is exerted upon pressure responsive means 124 which force tends to move operator means 26' downwardly. Operator means 26' in turn moves valve mandrel means 28' downwardly. Movement of valve mandrel means 28' from its first position moves seal means 46' away from seat means 40 and opens the lateral extending passage means through housing means 132. Flow through the lateral extending passage means is restricted by the two staged flow restriction means. The staged flow restriction means prevents a high velocity rate of fluid flow past the resilient seal means 46'. Additionally, an ever increasing volume of fluid is provided to feed the pressure generating pump 80. However, valve mandrel means 28' slides easily from its first position towards its second position, with minimal frictional resistance, so that the fluid pressure force generated by the initial pump 80 discharge is sufficient to move valve mandrel means 28. Thereafter, an ever increasing volume of fluid feeds the pump and the pressure generating pump 80 provides an ever increasing pressure for the discharged fluid. The force effective across the pressure responsive means 124 therefore increases. That force becomes great enough to move actuator means 30' and actuate the safety valve 82. Valve mandrel means 28' strikes the actuator means 30'. Actuator means 30' is moved from its first position to its second position. The main valve means 110 moves to its second, full open position. The open position of the sliding valve 20 and safety valve 82 illustrated in FIGS. 11A and 11B. The sliding valve 20 and the safety valve 82 are maintained in their open configuration as long as the pump motor 102 is on.

When it is desired to close the safety valve 82 and cease the production of well fluids, the pump motor 102 is turned off. With the pump motor 102 turned off, the pressure generating pump 80 no longer pressurizes the fluid within pressure chamber means 126. The downwardly acting force exerted on the pressure responsive means 124 reduces. Spring means 118 urges actuator means 30 upwardly. Main valve means 110 is moved to its first, closed position. The yieldable urging means 68' moves valve mandrel means 28' upwardly. Resilient seal means 46' reengages seat means 40. The laterally extending passage means through the housing means 32' is closed. The production of well fluids ceases.

The sliding valve 20 may be repeatedly operated so that the pump 80 may repeatedly actuate valve means 82. Therefore, the production of well fluids from the formation 86 may be controlled as desired.

From the foregoing it can be seen that the objects of this invention have been obtained. The sliding valve is easily opened. The valve mandrel is pressure balanced so that fluid forces do not have to be overcome to open the sliding valve. As the valve opens, an ever increasing volume of fluid is fed to a pressure generating pump. The pump in turn increases the pressure of fluid which acts to open the valve. Once the pressure is increased a sufficient amount, an actuator for another tool can be engaged and moved. The sliding valve therefore permits the actuation of a tool which previously could not be actuated due to the presence of an insufficient volume of feed fluid for the pressure generating pump. To permit the sliding valve to be opened and closed several times, with a pressure differential existing thereacross, the sliding valve includes a resilient seal. The resilient seal is protected. Major portion of the resilient seal is encapsulated within the valve mandrel. Additionally, flow through the sliding valve is restricted. The staged restriction means prevent high velocity flow across the resilient seal means. For further seal protection, a tortuous flow path through the valve's passage prevents flow across the resilient seal. Therefore, the likelihood that the resilient seal will wash out of position or will be subjected to wire drawing is reduced. With the seal protected, the use life of the installation will most likely not be limited by the use life of the sliding valve.

The foregoing disclosure and description of the invention are illustrative and explanatory thereof. Various changes in the size, shape and materials, as well as the details of the illustrated construction, may be made within the scope of the appended claims without departing from the spirit of the invention.

What is claimed is:

1. An installation comprising:

a fluid source region;

a fluid starved region;

tool means;

tool actuator means for actuating said tool means, said tool actuator means being axially movable;

pressure generating means for utilizing fluid within said fluid starved region for generating a source of pressurized fluid;

operator means affected by said source of pressurized fluid, said operator means being axially movable; and a sliding valve for admitting fluid from said fluid source region to said fluid starved region so that said pressure generating means has sufficient fluid for generating a source of fluid pressurized an amount sufficient to cause said operator means to move said actuator means a distance sufficient to actuate said tool means, said sliding valve comprising:

housing means, passage means extending laterally through said housing means and communicating between said fluid source region and said fluid starved region, seat member means carried by said housing means and including abutment seat means and a surface extending from said seat means, means for controlling flow through said passage means and including valve mandrel means axially movable with respect to said housing means between a first position and a second position and resilient seal means carried by said valve mandrel means for sealingly engaging said seat means when said valve mandrel means is in its first position, means for yieldably urging said valve mandrel means towards its first position, means responsive to the pressure of said fluid source region and said fluid starved region for at least substantially pressure balancing said valve mandrel means when said valve mandrel means is in its first position, and staged fluid flow restriction means for restricting fluid flow through said passage means during at least a portion of the movement of said valve mandrel means between its first and second positions, said staged fluid flow restriction means including a surface on said valve mandrel means adapted to be disposed opposite said surface of said seat member means when said valve mandrel means is in its first position so that said two surfaces define a restricted effective fluid flow area through said passage means during an initial portion of movement of said valve mandrel means from its first position towards its second position and additionally including second stage restriction means for providing graduated increasing flow areas through said passage means during a subsequent portion of movement of said valve means from its first position towards its second position.

2. The installation of claim 1 wherein:

said passage means includes port means extending laterally through said housing means and spaced longitudinally along said housing means so that said second stage flow restriction means moves thereby during movement of said valve means between its first and second positions.

3. An installation comprising:

tubular housing means for defining two pressure regions, one of said two pressure regions being a fluid source region and the other of said two pressure regions being a fluid starved region;

tool means;

tool actuator means axially movable with respect to said tubular housing means for actuating said tool means;

pressure generating means for utilizing fluid within said fluid starved region for generating a source of pressurized fluid;

operator means axially movable with respect to said tubular housing means when affected by said source of pressurized fluids; and sliding valve means for admitting fluid from said fluid source region to said fluid starved region so that said pressure generating means is fed a sufficient volume of fluid for generating a source of fluid pressurized an amount sufficient to cause said operator means to move said actuator means, said sliding valve means comprising:

passage means extending laterally through said tubular housing means for communicating between said two pressure regions, annular seat member means carried by said housing means and including annular abutment seat means and cylindrical surface means extending from said seat means, means for controlling flow through said passage means and including valve mandrel means axially movable with respect to said housing means between a first position and a second position and resilient seal means carried by said valve mandrel means for sealingly engaging said seat means when said valve mandrel means is in its first position, means for yieldably urging said valve mandrel means towards its first position, means responsive to the pressure of said two pressure regions for at least substantially pressure balancing said valve mandrel means when said valve mandrel means is in its first position, and multiple stage flow restriction means for restricting flow through said passage means during at least a portion of the movement of said valve means between its first and second positions, said multiple stage flow restriction means providing an ever increasing effective flow area through said passage means during movement of said valve means for said first position to said second position and minimizes a high velocity fluid flow past said resilient seal means.

4. The installation of claim 3 wherein:

said valve mandrel means includes nose means extending from said resilient seal means and projecting along said cylindrical surface of said seat member means when said valve means is in its first position;

said nose means and said cylindrical surface being spaced and defining an effective flow area therebetween during an initial portion of movement of said valve means from said first position to said second position; and wherein a first stage of said multiple stage flow restriction means is provided by said nose means and said cylindrical surface.

5. The installation of claim 3 wherein:

said passage means includes port means extending laterally through said housing means and spaced longitudinally along said housing means;

said multiple stage flow restriction means additionally includes ring means carried by said valve mandrel means and slidably engaging said tubular housing means, said ring means being spaced to pass by said port means during movement of said valve means between its first and second positions and thereby selectively restrict flow through said passage means.

6. The installation of claim 5 wherein:

at least one of said ring means has ends which define a sized gap therebetween.

7. The installation of claim 5 wherein:

at least one of said ring means has ends which abut.

8. A sliding valve comprising:

tubular housing means for defining two pressure regions; passage means for communicating between said two pressure regions and including at least a portion extending laterally through said tubular housing means;

seat member means carried by said tubular housing means and including:

seat means disposed in close proximity to said portion of said passage means extending laterally through said tubular housing means, and surface means extending from said seat means;

means for controlling flow through said passage means and including:

valve mandrel means axially movable with respect to said tubular housing means between a first position and a second position, and resilient seal means carried by said valve mandrel means for sealingly engaging said seat means when said valve mandrel means is in said first position;

means for yieldably urging said valve mandrel means to its first position;

means responsive to the pressure of said two pressure regions for at least substantially pressure balancing said valve mandrel means when said valve mandrel means is in its first position; and multiple stage flow restriction means for restricting flow through said passage means during movement of said valve mandrel means between its first and second positions and including:

first stage of flow restricting means for defining the effective flow area through said passage means as quickly as possible during an initial portion movement of said valve mandrel means for its first position towards its second position, and second stage of flow restricting means for selectively restricting flow through said portion of said passage means extending laterally through said tubular housing means during movement of said valve mandrel means.

9. The sliding valve of claim 8 wherein:

said portion of said passage means extending laterally through said tubular housing means includes a plurality of series of port means with each series of port means being longitudinally spaced along said tubular housing means so that as said second stage of flow restricting means moves thereby, flow through selected series of port means may be substantially restricted.

10. The sliding valve of claim 8 wherein:

said valve mandrel means includes nose means extending from said resilient seal means and projecting along said cylindrical surface means when said valve mandrel means is in its first position with said nose means and said cylindrical surface means being spaced to define a flow area therebetween and functioning as said first stage of flow restricting means.

11. The sliding valve of claim 8 wherein said second stage of flow restricting means includes:

ring means carried by said valve mandrel means and positioned to selectively pass by said portion of said passage means extending laterally through said tubular housig means during movement of said valve mandrel means between its first and second positions with each of said ring means substantially restricting fluid flow across itself during movement of said valve mandrel means.

12. The sliding valve of claim 11 wherein: .
at least one of said ring has ends which define a sized gap therebetween.
13. The sliding valve of claim 11 wherein:
at least one of said ring means has ends which abut.
14. The sliding valve of claim 8 wherein:
said portion of said passage means extending laterally through said tubular housing means includes a plurality of series of port means with each series of port means being longitudinally spaced along said tubular housing means; and
said second stage of flow restricting means includes ring means carried by said valve mandrel means and positioned to selectively pass by selected series of port means during movement of said valve mandrel means between its first and second positions with each of said ring means substantially restricting fluid flow across itself during movement of said valve mandrel means.
15. The sliding valve of claim 14 wherein:
at least one of said ring means has ends which define a sized gap therebetween.
16. The sliding valve of claim 14 wherein:
at least one of said ring means has ends which abut.

* * * * *